US005346753A

United States Patent [19]

Ostrower

[11] Patent Number: 5,346,753

[45] Date of Patent: Sep. 13, 1994

[54] POWDER PUFF

[75] Inventor: William K. Ostrower, Oyster Bay Cove, N.Y.

[73] Assignee: Penthouse Manufacturing Co., Inc., Freeport, N.Y.

[21] Appl. No.: 120,533

[22] Filed: Sep. 14, 1993

[51] Int. Cl.[5] ..... B05D 3/02; A45D 33/34

[52] U.S. Cl. ..... 428/220; 428/271; 428/280; 428/359; 428/365; 428/423.7; 428/297; 428/300; 428/369; 428/375; 315/208; 315/229.14

[58] Field of Search ..... 15/208, 229.14; 428/320.2, 280, 220, 423.7, 221, 359, 365, 297, 300, 369, 375

[56] References Cited

U.S. PATENT DOCUMENTS

| | | | |
|---|---|---|---|
| 4,190,550 | 2/1980 | Campbell | 428/288 |
| 4,483,897 | 11/1984 | Fujimura et al. | 428/288 |
| 4,559,157 | 12/1985 | Smith et al. | 252/90 |
| 4,698,871 | 10/1987 | Patkos | 428/288 |
| 4,877,215 | 10/1989 | Marume et al. | 249/109 |
| 4,917,134 | 4/1990 | Simonzi | 132/320 |
| 5,205,301 | 4/1993 | Nakamura | 252/90 |

*Primary Examiner*—Patrick J. Ryan
*Assistant Examiner*—Richard C. Weisberger
*Attorney, Agent, or Firm*—Rosenman & Colin

[57] ABSTRACT

A powder puff has a polyester pile fabric for applying cosmetics or the like to the skin.

10 Claims, 1 Drawing Sheet

POWDER PUFF

FIELD OF THE INVENTION

The present invention relates to a powder puff for applying facial cosmetics or the like, and more particularly to a powder puff having a hypoallergenic polyester pile fabric.

DESCRIPTION OF PRIOR ART

Powder puffs are customarily formed with a cotton pile fabric on one side, a cloth fabric on the other side for decoration or trim, and a soft inner filler to provide the powder puff with the desired tactile feel.

Cotton pile fabric is, of course, formed of a natural fiber and hence for some people this may be unacceptable. It would therefore be desirable to provide a powder puff with a hypoallergenic pile fabric that had the aesthetic appearance and pleasant tactile characteristics of a cotton pile fabric.

BRIEF SUMMARY OF THE INVENTION

The present invention now provides a powder puff with opposed faces and a polyester pile fabric on at least one face for applying cosmetics or the like to the skin, the polyester pile fabric being formed from a multi-filament polyester yarn of from about 250 to about 850 denier, the filaments of the yarn having a denier per filament of from about 0.75 to about 5 d.p.f. Preferably the other face of the powder puff is covered by a fabric trim, and a filler is between the faces.

DETAILED DESCRIPTION OF THE PREFERRED EMBODIMENTS

Figure 1:
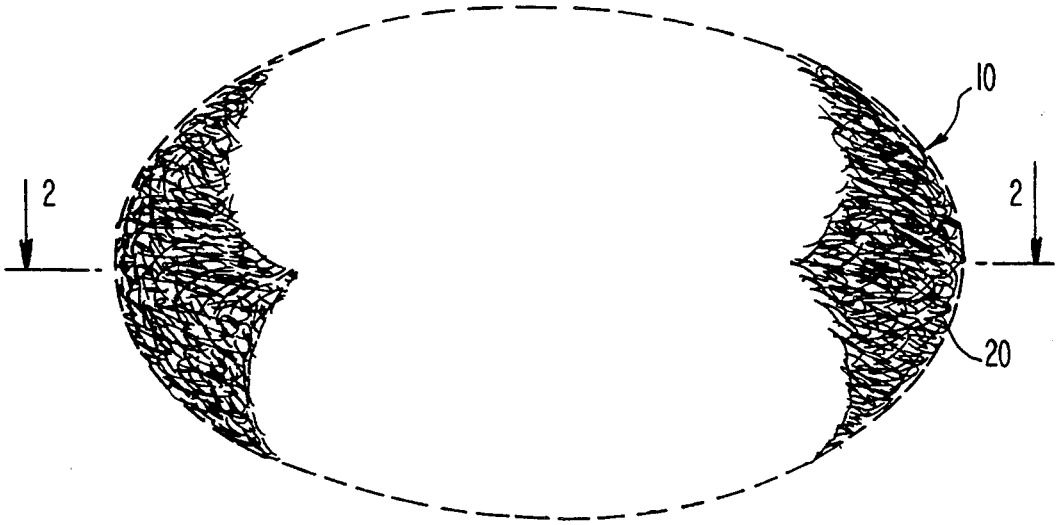
FIG. 1 is a perspective view of a powder puff embodying the present invention.
Figure 2:
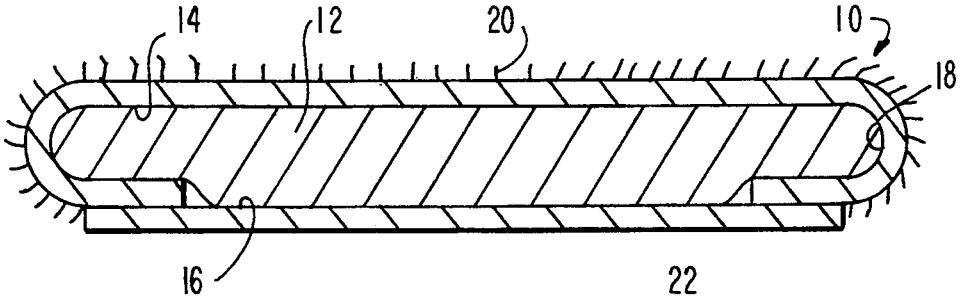
FIG. 2 is an elevational view in section taken along lines 2—2 in FIG. 1.

In FIGS. 1 and 2 there is shown a powder puff 10 having a inner filler 12. The filler 12 includes a first face 14 and a second opposite face 16. In a preferred embodiment, the powder puff 10 is circular in plan view, but other shapes may be used. Generally, the powder puff 10 is formed to fit a compact case in which it is to be placed. The filler 12 may be any known material used in powder puffs, such as cotton, kapok or other material. The filler 12 may be a cotton fiber pad covered on both faces by paper. Preferably, filler 12 is a non-woven synthetic, such as non-woven polypropylene.

The powder puff 10 includes a polyester pile fabric 20 covering the first face 14 of the filler 12. Preferably, the pile fabric 20 extends over the entire first face 14 and around the edge 18 of the filler 12 to the second face 16.

A fabric trim 22 covers the second face 16 and extends to meet the pile fabric 20 at the edge of the filler 12. The fabric trim 22 may be bonded, sealed, or sewn to the edges of the pile fabric 20. Preferably, the edges of the pile fabric 20 overlap the edges of the fabric trim 22 so that the filler 12 is completely enclosed. Fabric trim 22 may be any conventional fabric used in powder puffs, such as silk or satin fabric. It is presently preferred to use a satin acetate fabric as fabric trim 22.

In a presently preferred embodiment of the invention, the polyester pile fabric 20 is a polyester cut pile fabric knitted or woven as double pile fabric from a multi-filament polyester yarn of from about 250 to about 850 denier, preferably from about 350 to about 650 denier, wherein the denier per filament (d.p.f.) is from about 0.75 to about 5 d.p.f., preferably from about 1.5 to about 3.5 d.p.f, and then cut in a conventional manner to form the cut pile fabric. The multi-filament polyester yarn may be made of a single strand of multi-filament yarn or it may be formed of a plurality of interlaced strands of multi-filament yarns.

A powder puff according to the invention has been prepared using a polyester cut pile fabric knit or woven as a double pile fabric from two interlaced, 250 denier multi-filament polyester yarns, each 250 denier yarn having 100 filaments of 2.5 denier per filament, and then cut. The polyester cut pile fabric may be woven with from about 20 to about 30 ends per inch and from about 30 to about 40 picks per inch, and may have a pile height of from about 2 to about 6 mm. This powder puff is indistinguishable from a cotton pile powder puff in appearance and "feel", and yet is hypoallergenic.

I claim:

1. A powder puff having opposed faces and a polyester pile fabric on at least one face for applying cosmetics or the like to the skin, the polyester pile fabric being formed from a multi-filament polyester yarn of from 250 to about 850 denier, the filaments of the yarn having a denier per filament of from about 0.75 to about 5 d.p.f., wherein said polyester pile fabric has the aesthetic appearance and tactile characteristics of cotton pile fabric.

2. The powder puff according to claim 1, wherein said multi-filament polyester yarn has a denier of from about 350 to about 650 denier.

3. The powder puff according to claim 1, wherein the denier per filament of said yarn is from about 0.75 to about 5 d.p.f.

4. The powder puff according to claim 2, wherein the denier per filament of said yarn is from about 1.5 to about 3.5 d.p.f.

5. The powder puff according to claim 1, wherein said polyester pile fabric is a knit or woven polyester cut pile fabric.

6. The powder puff according to claim 1, wherein said polyester pile fabric is a polyester cut pile fabric knit or woven with from about 20 to about 30 ends per inch and from about 30 to 40 picks per inch, and has a pile height of from about 2 to about 6 mm.

7. The powder puff according to claim 2, wherein said polyester pile fabric is a polyester cut pile fabric knit or woven with from about 20 to about 30 ends per inch and from about 30 to 40 picks per inch, and has a pile height of from about 2 to about 6 mm.

8. The powder puff according to claim 3, wherein said polyester pile fabric is a polyester cut pile fabric knit or woven with from about 20 to about 30 ends per inch and from about 30 to 40 picks per inch, and has a pile height of from about 2 to about 6 mm.

9. The powder puff according to claim 4, wherein said polyester pile fabric is a polyester cut pile fabric knit or woven with from about 20 to about 30 ends per inch and from about 30 to 40 picks per inch, and has a pile height of from about 2 to about 6 mm.

10. The powder puff according to claim 1, wherein said polyester fabric is on one face and a fabric trim is on the other face, and an inner filler is between said faces.

* * * * *